United States Patent [19]

Hirtsiefer et al.

[11] 4,440,046

[45] Apr. 3, 1984

[54] POWER WRENCH

[75] Inventors: Karl-Richard Hirtsiefer, Neunkirchen; Johann Müller, Much-Nesshoven; Kurt Walterscheid, Ruppichteroth; Paul-Heinz Wagner, c/o Maschinenfabrik Wagner GmbH & Co. KG, D-5203 Much-Birrenbachshöhe Nr., Fed. Rep. of Germany

[73] Assignee: Paul-Heinz Wagner, Much-Birrenbachshöhe, Fed. Rep. of Germany

[21] Appl. No.: 238,079

[22] Filed: Feb. 25, 1981

[30] Foreign Application Priority Data

Mar. 5, 1980 [DE] Fed. Rep. of Germany ..... 3008332
Mar. 5, 1980 [DE] Fed. Rep. of Germany ..... 3008381

[51] Int. Cl.[3] ..... B25B 13/46
[52] U.S. Cl. ..... 81/57.39
[58] Field of Search ..... 81/57.39, 61

[56] References Cited

U.S. PATENT DOCUMENTS 2,707,412 5/1955 Brame ..... 81/61
2,787,180 4/1957 Fish ..... 81/61
4,201,099 5/1980 Junkers ..... 81/57.39
4,304,157 12/1981 Yamada et al. ..... 81/57.39

FOREIGN PATENT DOCUMENTS 2256803 5/1975 France ..... 81/57.39
814703 3/1981 U.S.S.R. ..... 81/57.39

*Primary Examiner*—James L. Jones, Jr.
*Attorney, Agent, or Firm*—Spensley, Horn, Jubas & Lubitz

[57] ABSTRACT

This power wrench includes a wrench head that rotatably supports a ring having a non-circular internal profile. A ratchet device moves the ring only in one direction of rotation with respect to the wrench head. The wrench head has an internal extension and a support element is coaxially pivotally attached to the wrench head. A piston cylinder unit, including a piston and a piston rod is provided. The first end of the piston cylinder unit is rigidly connected to the integral extension of the wrench head and the second end of the unit is in contact with the support element. The distance between the center of the wrench head and the first end of the piston cylinder unit is about the same as the distance between the center of the wrench head and the second end of the unit. One end of the piston rod is flexibly held at the piston and the other end is flexibly held at the support element.

16 Claims, 2 Drawing Figures

POWER WRENCH

The invention relates to a power wrench comprising a head in which a ring connectible to a screw head, is supported, an entraining device moving the ring only in one sense of rotation of the wrench head, and a piston cylinder unit pressing with its one end against an extension of the wrench head and with its other end against a support element which is pivoted at the wrench head.

A known power wrench of this type (DE-OS No. 27 46 632) comprises a piston cylinder unit having a piston which extends nearly rectangularly relative to the extension of the wrench head and whose cylinder projects to a far extent from the wrench head. The rear end of the cylinder rests against the support element which is pressed against a fixed point, e.g. an adjacent bolt. The cylinder and the support element encompass a very acute angle. Therefore, to receive the longitudinal forces of the cylinder, there are provided lateral plates which are pivoted at the cylinder at the one hand and at the screw head, on the other hand. To house the piston cylinder unit, the support element and the lateral plates of the known power wrench are much longer than the extension of the wrench head. As a result, the dimensions of the power wrench are relatively great and its weight is high. However, the applicability of a power wrench substantially depends upon its size which should be as small as to permit its use in points where a big device cannot be applied, while its weight should be as low as to allow to fit it to and to reset it at a screw accordingly.

It is an object of the invention to provide a power wrench of the mentioned type which is of a small size and which, as compared to the known devices, can be designed to be of a light weight as well.

To solve the problem, it is provided in the invention that the effective lengths of the support element, on the one hand, and of the extension of the wrench head, on the other hand, based on the center point of the wrench head, differ from each other by less than factor 1.5 and are in particular substantially equal in size.

The effective lengths of the two elements engaged by the piston cylinder unit being substantially equal, the power of the piston cylinder unit is well utilized because the piston cylinder unit forms, in a way, the basis of an equilateral triangle. Due to the favorable power distribution the piston cylinder unit can be designed to be relatively small. As a result of the small size of the total power wrench, it can be handled more easily. The piston cylinder unit engaging the wrench head extension at a relatively large angle, additional lateral plates which receive tensile stresses between the rear end of the piston cylinder unit and the wrench head are unnecessary.

It is not necessary for the length of the support element and of the extension of the wrench head to be exactly of the same dimension. It will do, on the contrary, if both lengths are in the same order which can be limited in that the two lengths differ by less than factor 1.5. Preferably the factor by which the two lengths differ is however, less than 1.2.

An advantageous further embodiment of the invention permits a considerable reduction in size and a simplified production in that the cylinder of the piston cylinder unit is rigidly connected to the extension of the wrench head, while the piston rod flexibly engaging the support element is also flexibly engaging the rear side of the piston. To this effect, no separate piston cylinder unit is required, but the cylinder is integrated, so to speak, in the extension of the wrench head. Hence, the piston is directly moved out of the wrench head extension to press against the support element.

A firm connection or one-piece design of the wrench head and the cylinder not enabling the cylinder to swing relative to the wrench head, the piston-side end of the piston rod must be flexibly connected with the piston so that the piston rod is connected to the support element via a first joint and to the piston via a second element; subject to the corresponding stroke position of the piston, the angle of the piston rod is freely adjustable.

In a favorable embodiment of the invention, and to permit the required swing movements of the piston rod, a substantial portion in length of the piston rod is surrounded at a distance with a jacket firmly secured to the piston and leading out of the cylinder through a sealed aperture. Within the jacket the freedom of motion of the piston rod is sufficient so as to permit its adjustment to the different positions of the support element and of the wrench head relative to each other. The axial length of the piston by itself is relatively short and it is engaged still inside the cylinder by the swivable piston rod. This results in a short constructional length of the piston cylinder unit because the required pivot point is inside the cylinder directly at the piston or in the height of the piston base.

During the operational movement of the piston, i.e. if the extension or projection of the wrench head and the support are pressed apart, the piston force required is relatively high while the force needed for the return stroke of the piston is much inferior thereto. If the design deals with a double acting cylinder whose two fluid connections can be connected alternately to a pressure line and to a return line, the rear cylinder chamber, due to the jacket surrounding the piston rod, has a relatively small volume, and the rear piston surface is also rather small. Therefore, a small fluid amount will do to move the piston again to the return position so that the return stroke will be performed at a higher speed and with a smaller amount of fluid than the working stroke.

If the piston cylinder unit is provided near the ring, the resulting lever paths are short, and a high force is needed to apply the required torque. The joints of the piston-cylinder unit have to withstand high stresses accordingly. To this end, at least one end of the piston rod is provided with a spherical recess housing a ball which is supported in a corresponding recess of the support element or of the piston. Surprizingly, it turned out that a joint which has to withstand a specific stress can be made with the use of substantially smaller dimensions than the usual joint constructions when it is supported by means of a ball which is disposed in two cups. The reason for it appears to be the fact that in case of a ball, upon an initial deformation, a fully flat abutment of the corresponding elements will take place so that the distribution of the transmitted load is better than for inst.with a cylindrical bolt of a joint connection. In addition, the adaptation to the power-receiving or the power transmitting constructional elements is excellent, because the adaptation in each direction is perfect and no shearing effects will come up.

To permit a continuous rotation of a screw, which does not have a great moment of resistance, and to exlude the need of moving it with a great number of strokes of the piston-cylinder unit, it is provided, according to an advantageous embodiment of the invention, that the wrench head is supported by a toothed wheel which intermeshes with teeth of the ring and can be rotated in one direction independently of an actuation of the piston-cylinder unit.

A preferred embodiment of the invention will be explained more closely hereinafter with reference to the Figs.

Figure 1:
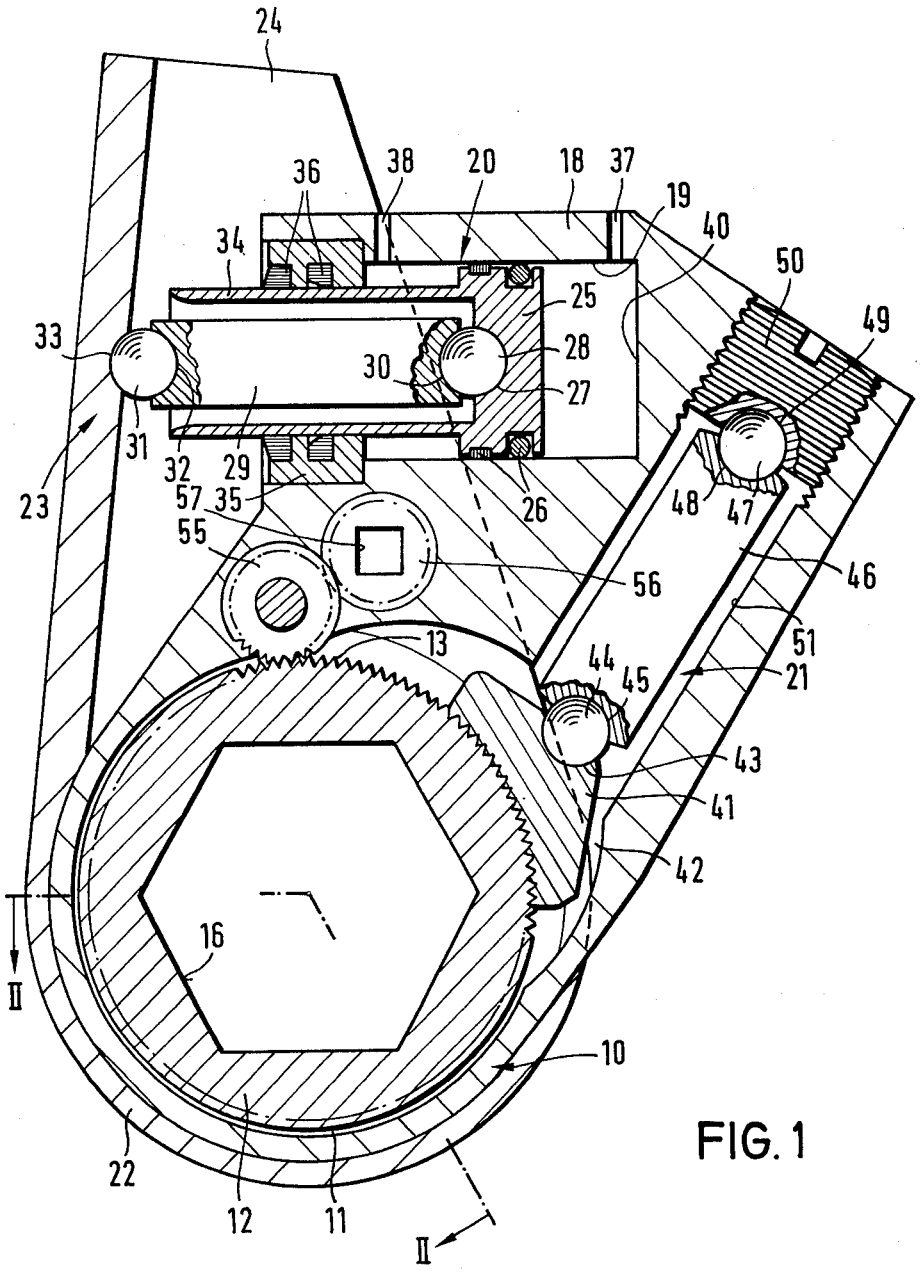
FIG. 1 shows a schematic longitudinal section of a power wrench.

The illustrated power wrench has a wrench head 10 which has a substantially circular recess 11 in which a ring 12 is pivoted. The external surface of the ring 12 is cylindrical and, in the central region thereof, it is provided with external teeth 13. At both sides of the external teeth 13, the ring 12 has cylindrical bearing surfaces 14 and 15. The inside of the ring 12 is designed in form of a hexagonal channel 16 or in the form of another non-circular internal profile. It is possible to introduce into the hexagonal channel 15 for inst. a button die which, by this means, can be mounted rotatingly integral with ring 12.

Figure 2:
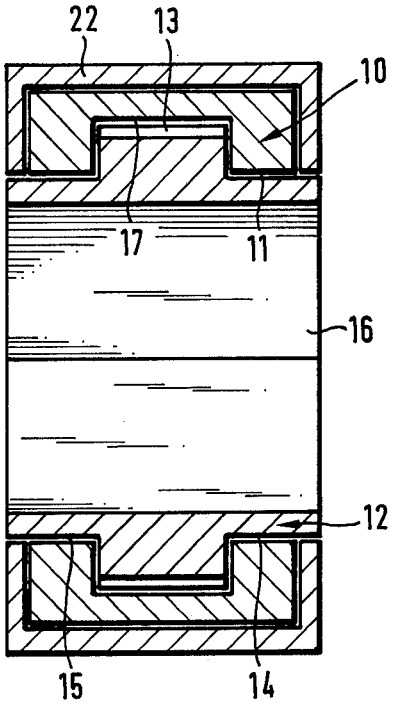
FIG. 2 is a section along line II—II of FIG. 1.

As evident from FIG. 2, the wrench head 10 encompassing a considerable portion of the periphery of ring 12 has a groove 17 extending roundabout internally and offering space to receive the external teeth 13 of ring 12. The faces 11 at both sides of the annular groove 17 are running on the bearing surfaces 14 and 15 so that the wrench head 10 and the ring 12 can be centered relative to each other.

The wrench head 10 has a radially projecting extension 18 which contains the cylinder bore 19 of the piston cylinder unit 20 and a ratchet 21.

Except for the extension 18, the wrench head 10 is enclosed by the support ring 22 of the support element 23. The cross section of the support ring 22 is U-shaped, the front sides of its legs sliding on the bearing surfaces 14,15 of ring 12. The support ring 22 enclosing the wrench head 10 has an aperture for the passage of the extension 18. The support element 23 comprises a plate extending nearly tangentially relative to the wrench head 10 or to the ring 12 and forming a U-shaped structure with the lateral plates 24. As shown in FIG. 1, the extension 17 protrudes between the lateral plates 24 of the support element 23.

The piston 25 is displaceable in the cylinder bore 19 of the extension 18. The piston is sealed with seals 26 against the cylinder wall. At its rear side, it is provided with a cup-shaped recess 27 in which a suitable steel ball 28 is fitted, against which the piston rod 29 also provided at its front end with a cup-shaped recess 30 is pressing. Thus, the steel ball 28 together with the cup-shaped recesses 27 and 30 forms a joint loaded in pressure.

A similar joint is at the other end of the piston rod 29. Said joint comprises a ball 31 situated in a cup-shaped recess 32 of the end of the piston rod 29 and in a cup-shaped recess 33 of the support element 23.

The piston rod 29 is surrounded by a cylindrical jacket 34 which is firmly connected to the piston 25. The end of the cylinder bore 29 is closed by a bushing 35 and sealed against the jacket 34 by means of seals 36. The cylinder of the piston cylinder unit 20 is of a double-acting design and it is connected to a first connecting line 37 and a second connecting line 38. If the first connecting line 37 is under the action of pressure, the second connecting lines 38 serves as a return line and vice versa. The first connecting line 37 extends into the rear end of the cylinder bore 19, and the second connecting line 38 extends into the front end of the cylinder bore 19.

The lines extending to the terminals are not illustrated. To prevent the extension 18 and the support element from being swivelled apart, the jacket 34 is connected to the support element 23 by a (non-illustrated) spring.

As illustrated in FIG. 1, the distances of balls 28 and 33 from the center of ring 12 or of the wrench head 10 are approximately equal. If pressure is introduced through the inlet 37 into the cylinder bore 19, the piston 25 is moved out (to the left according to FIG. 2). If the support element 23 is placed against a (non-illustrated) solid abutment, the extension 18 is rotated clockwise around the center of ring 12. The point of attack of the pressure at the extension 18 is in the center 40 of the front face of the cylinder bore. The distance of point 40 from the center of ring 12 is not essentially greater than the distance of ball 31 from the center of ring 12 so that the support element 23 and the arm 18 are effectively pressed apart by the piston-cylinder unit.

The ratchet 21 which, with a swing movement of the wrench head 10 entrains the ring 12, but only in one direction (clockwise), while a free return motion in the counterdirection is possible for the wrench head, is also housed in the projecting extension 17 of the wrench head 10 in the described embodiment. Said ratchet consists of a toothed segment 41 housed in a cavity 42 of the wrench head 10, the teeth intermeshing with the external teeth 13 of ring 12. Along an inclined shoulder at its rear side, the toothed segment 41 has a cup-shaped recess 43 into which a ball 44 is placed, which also projects into a cup-shaped recess 45 at the front side of a pressure member 46. The rear end of the pressure member 46 is also supported at a screw member 50 by means of a ball 47 which is situated in two cups 48, 49. The pressure member 46 is housed in a bore 51 of the extension 18. The outer end of the bore is threaded and closed with the screw member 50. The internal end of bore 51 ends in the cavity 42.

The extension of the axis of bore 51 intersects as a secant the circle of the external teeth 13 of ring 12. Said secant extends somewhat outside the center of the radius being vertical on it.

The diameter of the bore 51 being as great as to permit for the pressure member 46 to perform oscillating movements in the bore 51, the toothed segment 41 can become disengaged from the intermeshing with the external teeth 13. However, if the extension 18 is swivelled clockwise, the pressure member 46 acts by way of the joints formed by balls 44 and 47 as a toggle lever system by which the toothed segment 41 is pressed into teeth 13. As a result, upon a rotation of the wrench head 10 in clockwise direction, the ring 12 is entrained via the ratchet 21.

With a rotation of the wrench head 10 in anticlockwise direction, the toothed segment 41 is disengaged from its intermeshing with the teeth 13 so that no carrying along operation will take place.

The rotation of ring 12 being relatively slow by the great number of strokes of piston 25, a toothed wheel 55 is situated inside the wrench head and is in engagement with the outer teeth 13 of ring 12. The toothed wheel 55 is freely pivoted at the wrench head 10 and intermeshes with another toothed wheel 56 which is also supported at the wrench head 10. The second toothed wheel 56 has an internal square 57 into which a tool may be inserted to rotate manually ring 12. By this means, it is possible to tighten screws with a low torque, before the real tightening operation is carried out by the piston-cylinder unit 20.

What is claimed is:

1. A power wrench comprising:
a wrench head in which a ring containing a non-circular internal profile is supported;
a ratchet device moving said ring only in one direction of rotation of said wrench head;
a solid extension of said wrench head;
a support element pivoted at said wrench head;
a piston-cylinder unit including a piston rod and a cylinder, said cylinder being integral with said solid extension of said wrench head,
the first end of said piston-cylinder unit in contact with said solid extension of said wrench head and the second end of said unit in contact with said support element;
wherein the distance between the center of said wrench head and said first end is substantially equal to the distance between the center of said wrench head and said second end;
whereby said piston moves directly out of said solid extension of said wrench head to press against said support element and impart a turning motion to said wrench head, and
wherein the cylinder of said piston-cylinder unit is rigidly connected to said wrench head extension and the rod of said piston-cylinder unit flexibly engages said support element and also flexibly engages the rear side of the piston of said piston-cylinder unit.

2. A power wrench according to claim 1 wherein a substantial portion of the length of said rod is surrounded by a jacket firmly connected to said piston and extending out of said cylinder through a sealed aperture.

3. A power wrench according to claim 1 wherein said cylinder is a double-acting cylinder containing two fluid connections which may be connected alternately to a pressure line and a return line.

4. A power wrench according to claim 1 wherein at least one end of said rod is provided with a cup-shaped recess in which a ball is situated, said ball also being supported in a corresponding recess of said support element or of said piston.

5. A power wrench according to claim 1 wherein the two flexible engagement points of said rod are equidistant from the center of said wrench head in a specific piston position.

6. A power wrench according to claim 1 wherein a toothed wheel is supported at said wrench head and intermeshes with teeth of said ring, said toothed wheel capable of rotation in one direction independently of an actuation of said piston-cylinder unit.

7. A power wrench according to claim 1 further comprising:
a plurality of teeth disposed about the periphery of said ring;
a toothed segment intermeshing with the teeth of said ring;
wherein said ring slides past said toothed segment in one direction of rotation and engages said toothed segment in a blocking manner in the other direction of rotation; and
wherein said toothed segment is supported via a first joint by a pressure member movable in a bore of said wrench head, said pressure member bieng supported via a second joint at the rear wall of said bore, said toothed segment and said pressure member together forming a toggle lever system.

8. A power wrench according to claim 7 wherein the extended center axis of said bore intersects nearly perpendicularly a radius of said ring at a point which is nearly in the center of said radius.

9. A power wrench according to claim 7 wherein the extended center axis of said bore intersects perpendicularly a radius of said ring at a point which, measured from the ring center, is between the center and two thirds of the length of said radius.

10. A power wrench according to claim 7 wherein at least on of said joints consists of a ball which partly rests in a cup-shaped recess of said pressure member and partly in a cup-shaped recess of said toothed segment or the rear wall of said bore.

11. A power wrench according to claim 7 wherein said toothed segment has a base portion adapted to the circumferential circle of the teeth of said ring and from which project several notches, the teeth of said ring and the notches of said toothed segment being designed as fine toothing.

12. A power wrench according to claim 7 wherein the rear wall of said bore is formed by a plug adjustable in a thread.

13. A power-driven tool for transmitting a torque, and in particular a power wrench, comprising:
a wrench head in which a ring containing a non-circular internal profile is rotatably supported;
a ratchet device for moving said ring only in one direction of rotation with respect to said wrench head;
an integral extension of said wrench head;
a support element coaxially pivotally attached to said wrench head; and
a piston-cylinder unit including a piston and a piston rod, the first end of said piston-cylinder unit being rigidly connected to said integral extension of said wrench head and the second end of said unit being in contact with said support element;
wherein the distance between the center of said wrench head and said first end is about the same as the distance between the center of said wrench head and said second end; and
wherein one end of the said piston rod is flexibly held at the piston and the other end of said piston rod is flexibly held at the support element;
whereby said piston moves directly out of said integral extension of said wrench head to press against said support element and impart a turning motion to said wrench head.

14. A power-driven tool for transmitting a torque, and in particular a power wrench, comprising:
a wrench head in which a ring containing a non-circular internal profile is rotatably supported;
a ratchet device for moving said ring only in one direction of rotation with respect to said wrench head;
an integral extension of said wrench head;
a support element coaxially pivotally attached to said wrench head; and
a pressure cylinder, the first end of said pressure cylinder being rigidly connected to said integral extension of said wrench head and the second end of said pressure cylinder being in contact with said support element;

a piston within said pressure cylinder; and a piston rod extending between and being flexibly attached to each of the piston and the extension;

whereby said piston moves directly out of said integral extension of said wrench head to press against said support element and impart a turning motion to said wrench head.

15. A power wrench comprising:

a wrench head in which a ring containing a non-circular internal profile is supported;

a ratchet device moving said ring only in one direction of rotation of said wrench head;

a solid extension of said wrench head;

a support element pivoted at said wrench head;

a piston-cylinder unit including a piston rod, the first end of said piston-cylinder unit in contact with said solid extension of said wrench head and the second end of said unit in contact with said support element wherein the distance between the center of said wrench head and said first end is substantially equal to the distance between the center of said wrench head and said second end; and wherein the cylinder of said piston-cylinder unit is rigidly connected to said wrench head extension and the rod of said piston-cylinder unit flexibly engages said support element and also flexibly engages the rear side of the piston-cylinder unit.

16. A power wrench comprising:

a wrench head in which a ring containing a non-circular internal profile is supported;

a ratchet device moving said ring only in one direction of rotation of said wrench head;

a plurality of teeth disposed about the periphery of said ring;

a toothed segment intermeshing with the teeth of said ring;

wherein said ring slides past said toothed segment in one direction of rotation and engages said toothed segment in a blocking manner in the other direction of rotation;

wherein said toothed segment is supported via a first joint by a pressure member movable in a bore of said wrench head, said pressure member being supported via a second joint at the rear wall of said bore, said toothed segment and said pressure member together forming a toggle lever system; and wherein the rear wall of said bore is formed by a plug adjustable in a thread.

* * * * *